United States Patent [19]

Bergandy

[11] Patent Number: 4,569,378

[45] Date of Patent: Feb. 11, 1986

[54] FILLING MACHINE WITH TANDEM-OPERATED DIAPHRAGM FILLING UNITS

[75] Inventor: Wieslaw Bergandy, Arnold, Md.

[73] Assignee: National Instrument Company Inc., Baltimore, Md.

[21] Appl. No.: 541,232

[22] Filed: Oct. 12, 1983

Related U.S. Application Data

[63] Continuation-in-part of Ser. No. 449,196, Dec. 13, 1982, which is a continuation-in-part of Ser. No. 350,649, Feb. 22, 1982, abandoned.

[51] Int. Cl.[4] ..... B65B 65/02

[52] U.S. Cl. ..... 141/266; 141/89; 141/129; 141/146; 92/13.8; 92/98 D

[58] Field of Search ..... 141/67, 89, 27, 91, 141/129, 146, 147, 164, 168, 266, 285, 368, 392; 92/98 D, 98 R, 87, 78, 101, 136, 13.2, 13.7, 13.8; 222/148, 309, 334

[56] References Cited

U.S. PATENT DOCUMENTS

| | | | |
|---|---|---|---|
| 2,736,294 | 2/1956 | Buehner | 92/13.8 |
| 2,950,739 | 8/1960 | Lofinik | 137/788 |
| 2,966,143 | 12/1960 | Panza | 92/13.8 X |
| 2,974,640 | 3/1961 | Lindbom et al. | 91/47 |
| 3,144,177 | 8/1961 | Cookson | 222/309 |
| 3,162,336 | 12/1964 | Erikson | 222/309 |
| 3,175,473 | 3/1965 | Boteler et al. | 92/165 R |
| 3,294,030 | 12/1966 | Fox | 91/459 |
| 3,339,464 | 9/1967 | Rietdijk | 92/98 |
| 3,393,612 | 7/1968 | Gorgens et al. | 92/101 |
| 3,769,794 | 11/1973 | Cachon | 60/594 |
| 3,769,879 | 11/1973 | Lofquist, Jr. | 92/84 |
| 3,804,135 | 4/1974 | Waxlax | 141/266 |
| 3,815,480 | 6/1974 | Spyra | 92/13.8 X |
| 4,077,441 | 3/1978 | Rosen et al. | 141/1 |
| 4,091,969 | 5/1978 | Easter et al. | 92/13.4 X |
| 4,215,625 | 8/1980 | Hoffman et al. | 92/48 |
| 4,281,777 | 8/1981 | Akens | 222/134 |
| 4,367,674 | 1/1983 | Inada et al. | 92/13.2 |

*Primary Examiner*—Stephen Marcus
*Assistant Examiner*—Ernest G. Cusick
*Attorney, Agent, or Firm*—Antonelli, Terry & Wands

[57] ABSTRACT

An improved filling machine with tandem-operated diaphragm filling units is disclosed. The filling machine comprises a plurality of individual filling units operated in common from a common drive bar. Each of the filling units includes a cylinder, a flexible rolling diaphragm secured within the cylinder to delimit a working chamber in the cylinder on one side of the diaphragm, a piston arranged with clearance in the cylinder on the other side of the diaphragm for reciprocation in the cylinder, the clearance between the piston and the cylinder permitting the flexible diaphragm to roll and unroll on the piston sidewall and cylinder wall during filling and discharging of a liquid from the working chamber of the filling unit, passages in the cylinder for providing fluid communication with the working chamber, a piston rod extending between the piston and the common drive bar for transmitting a driving force from the common drive bar to the piston during a discharge stroke of the filling unit, the sidewall of the piston and the cylinder wall upon which the diaphragm is rolled and unrolled being tapered in opposite directions a like degree to increase the life of the rolling diaphragm, and wherein the piston rod length is adjustable to permit a change in the distance that the piston penetrates into the cylinder with a given stroke length whereby the volume dispensed by an individual filling unit can be finely adjusted.

9 Claims, 5 Drawing Figures

FILLING MACHINE WITH TANDEM-OPERATED DIAPHRAGM FILLING UNITS

RELATED INVENTIONS

This application is a continuation-in-part application of applicant's earlier, copending application Ser. No. 449,196 filed Dec. 13, 1982 which, in turn, is a continuation-in-part application of application Ser. No. 350,649 filed Feb. 22, 1982, now abandoned.

BACKGROUND AND SUMMARY OF THE INVENTION

The present invention relates to an improved high-speed filling machine with tandem-operated diaphragm filling units each having means for finely adjusting the volume dispensed thereby.

Filling machines in which a certain number of relatively small containers such as bottles, ampoules, etc. conveyed on an endless continuously moving conveyor are to be simultaneously filled from nozzles adapted to be lowered into the containers are known in the art, for example, as described in the prior U.S. Pat. No. 2,807,213. These prior art filling machines utilize filling units as described, for example, in the U.S. Pat. No. 2,807,213 which are equipped with adjusting means for adjusting the amount dispensed during each discharge stroke by a respective filling unit by changing the eccentricity of the eccentric drive thereof. While this arrangement is quite satisfactory when each filling unit is driven individually and separately by a drive of its own, usually by the use of an eccentric drive as shown in the U.S. Pat. No. 2,807,213, such adjusting mechanism becomes inadequate when two or more filling units are driven in tandem from the same eccentric drive or drives, as described in U.S. Pat. No. 4,077,441 issued on Mar. 7, 1978, in the name of Sidney Rosen and Richard Nelson Bennett, entitled "Convertible Filling Machine", the contents of which are incorporated herein by reference.

More specifically, with the use of a convertible filling machine, as described in the aforementioned patent, the pre-existing adjusting mechanism is interposed between a respective eccentric drive and a common drive bar so that each filling unit can no longer be individually adjusted with respect to the amount discharged during its discharge stroke by changing the eccentricity of the eccentric drive. Yet, virtually all of assignee's automatic filling machines utilize a common drive bar to drive the individual filling units because such an arrangement offers the advantages of being less expensive than having individual drives for each filling unit and it is faster to change the fill volumes in such a filling machine as only one major fill adjustment is required.

However, due to the variations from one filling unit to the next mounted on the common drive bar of such a filling machine, it is necessary to fine tune each filling unit so that all of the filling units are dispensing the same amount of product. This problem has been solved with respect to filling units having a conventional piston-cylinder arrangement wherein a piston rod is connected to the piston to both push and pull the piston during the reciprocation or stroke of the piston by providing each of the individual filling units with a lost motion creating device between the common drive bar and the piston rod as disclosed in assignee's U.S. Pat. No. 4,212,416. The amount of lost motion, and hence the length of the piston stroke, is adjusted with the device to increase or decrease the amount discharged during each discharge stroke of the filling unit. However, this technique cannot be utilized on a diaphragm type filling unit wherein a positive differential pressure is maintained on the diaphragm at all times during operation of the filling units to bias the diaphragm against the adjacent piston of the filling unit.

Thus, an object of the present invention is to provide an improved filling machine with tandem-operated diaphragm filling units wherein the fill volume of the individual filling units can be finely adjusted although the filling units are driven from a common drive bar and operated with a positive differential pressure on the diaphragm thereof so as to bias the diaphragms against their respective pistons.

A further object of the present invention is to provide an improved filling machine with tandem-operated diaphragm filling units wherein the life of the rolling diaphragms of the filling units are considerably increased as compared with conventional rolling diaphragm pump arrangements.

These and other objects of the present invention are attained by providing a filling machine comprising a plurality of individual filling units operated in common from a common drive means with each of the individual filling units including a cylinder, a flexible rolling diaphragm secured within the cylinder to delimit a working chamber in a cylinder on one side of the diaphragm, a piston arranged with clearance in the cylinder on the other side of the diaphragm for reciprocation in the cylinder, the clearance between the piston and the cylinder permitting the flexible diaphragm to roll and unroll on the piston sidewall and cylinder wall during filling and discharging of a fluid from a working chamber of the filling unit, passage means in the cylinder for providing fluid communication with the working chamber, piston rod means extending between the piston and the common drive means for transmitting a driving force from the common drive means to the piston during a discharge stroke of the filling unit, the sidewall of the piston upon which the diaphragm is rolled and unrolled being tapered outwardly from the end of the piston adjacent the diaphragm to increase the life of the rolling diaphragm, and means for adjusting the length of the piston rod means to change the distance that the piston penetrates into the cylinder with a given piston stroke length whereby the volume dispensed by the individual filling unit can be finely adjusted.

According to a disclosed, preferred embodiment of the invention both the piston sidewall and the spaced, opposed wall of the cylinder between which the diaphragm is rolled and unrolled during filling and discharging are tapered a like degree in opposite directions so that the convolution width of the diaphragm remains essentially constant with reciprocation of the piston in the cylinder during operation of the filling unit. The constant convolution width prevents the diaphragm from wrinkling and being stressed during operation of the filling unit and thus considerably increases the operating or working life of the diaphragm as compared with conventional diaphragm pump arrangements.

In the preferred form of the filling machine of the invention the piston rod means comprises a two-part piston rod wherein the two parts of the piston rod are adjustably connected in telescoping relation by a threaded connection to provide the means for adjusting the length of the piston rod means. A first part of the two-part piston rod is connected to the common drive means of the filling machine and an end of a second part of the two-part piston rod contacts the piston during the discharge stroke of the filling unit. The piston is not connected to the piston rod but a positive differential pressure is maintained on the diaphragm during operation of the filling unit to bias the diaphragm against the piston and the piston against the piston rod. The end of the second part of the two-part piston rod which contacts the piston is rounded so that the piston can swivel about the piston rod to reduce the possibility of the diaphragm rubbing on itself.

Thus, the method of finely adjusting the volume dispensed by an individual filling unit of the filling machine according to the invention takes advantage of the fact that the cylinder of the filling unit is tapered outward and the rolling diaphragm piston is tapered inward. That is, according to the invention the volume dispensed by the filling unit is adjusted by changing the distance that the piston penetrates into the cylinder for a given piston stroke length. The deeper the piston penetrates into the cylinder, the larger is the diameter of the piston and cylinder and the effective diameter of the diaphragm associated therewith. As the effective diameter of the diaphragm is directly proportionate to the volume dispensed by the filling unit, by adjusting the distance that the piston penetrates into the cylinder for a given stroke length, the volume of fluid dispensed by the filling unit can be varied.

In the method of the invention, the step of changing the distance that the piston penetrates into the cylinder is effected by adjusting the length of the piston rod means extending between the piston and the common drive means. As discussed above, this is accomplished with the use of a piston rod means formed as a two-part piston rod where the two parts of the piston rod are adjustably connected in telescoping relation by a threaded connection to provide the means for adjusting the length of the piston rod means.

These and other objects, features and advantages of the present invention will become more apparent from the following description when taken in connection with the accompanying drawings which show, for purposes of illustration only, one embodiment in accordance with the present invention.

DESCRIPTION OF THE PREFERRED EMBODIMENT

Figure 1:
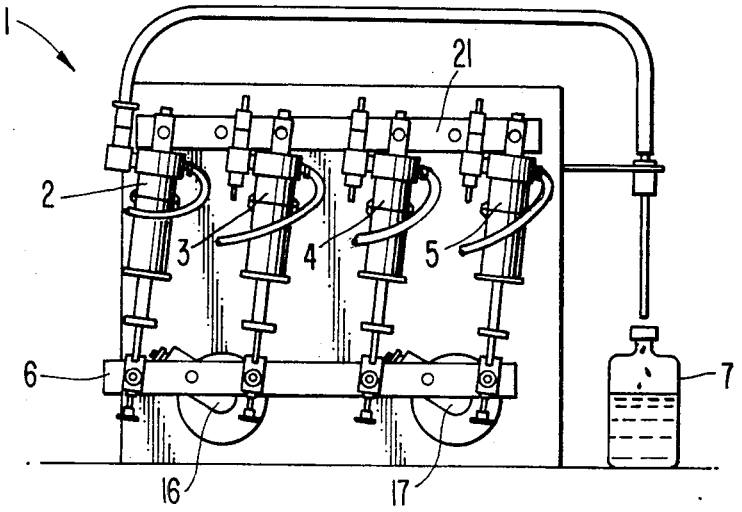
FIG. 1 is a somewhat schematic elevational view of a filling machine including several individual diaphragm filling units operated in tandem in accordance with the present invention.

Referring now to the drawings wherein like reference numerals are used throughout the various views to designate like parts, FIG. 1 illustrates a filling machine 1 according to the invention comprising four individual, tandem-operated diaphragm filling units 2–5 which are operated in common, from a common drive bar 6 in the manner disclosed in U.S. Pat. No. 4,077,441. The number of individual filling units may, of course, vary from installation to installation.

Each of the filling units or pumps 2–5 of the filling machine 1 is adapted to fill respective containers 7, only one of which is shown in FIG. 1, with a predetermined amount of a liquid product. The filling units each comprise a cylinder 8, a flexible rolling diaphragm 9 secured within the cylinder 8 to delimit a working chamber 10 in the cylinder on one side of the diaphragm, and a piston 11 arranged with clearance in the cylinder on the other side of the diaphragm for reciprocation in the cylinder. The clearance between the piston and the cylinder permits the flexible diaphragm to roll and unroll on the piston sidewall and cylinder wall during filling and discharging of a liquid from the working chamber of the filling unit. Inlet and outlet passages 12 and 13 are positioned on opposite sides of the cylinder at the end or top thereof for providing flow communication with the working chamber.

Figure 2:
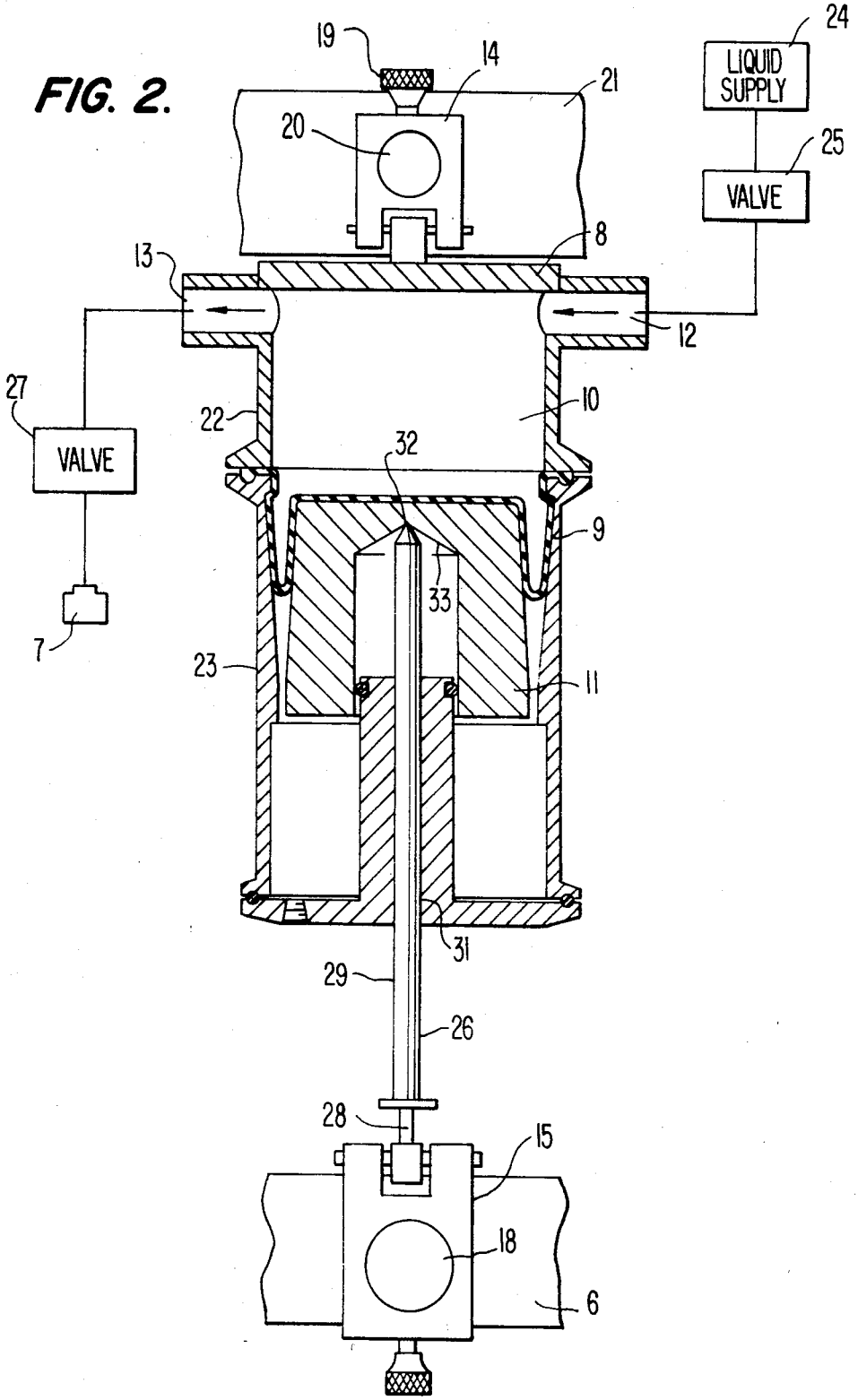
FIG. 2 is a side view, partially in cross-section and partially schematic, showing an individual filling unit of the filling machine of FIG. 1.

The filling units ar supported in a upright position during operation such that the cylinders thereof stand essentially vertically with the inlet passage 12 and outlet passage 13 in each cylinder being located at the top of the cylinder as shown in FIG. 2. Each filling unit is supported in this working position by an upper connection 14 and a lower connection 15 of the type disclosed in the commonly assigned U.S. Pat. No. 4,212,416. The lower connection 15 is to the common drive bar 6 which is operatively connected to two eccentric drive members 16 and 17 each provided with a micrometer volume control as disclosed in U.S. Pat. No. 2,807,213 to permit overall adjustment of the discharge stroke of all filling units. In particular, the lower connection 15 is a swivel assembly which connects the lower end of a piston rod 26 to the common drive bar 6. The swivel assembly of the lower connection includes a swivel pin 18 so that when the upper connection is released, the filling unit can be pivoted about the swivel pin of the lower connection from the upright operating position to an inclined or horizontal cleaning position. The upper connection 14 is released from an upper mounting bar 21 by loosening a thumb screw 19 holding the upper connection on a circularly shaped bearing member 20 of the upper mounting bar.

The flexible rolling diaphragm 9 is formed of rubber or a like material and is secured at its radially outer portions between upper and lower sections 22 and 23 of the cylinder 8 so as to define the working chamber 10 in the cylinder on one side of the diaphragm. The piston 11 is arranged with clearance in the cylinder on the other side of the diaphragm for reciprocation in the cylinder. The clearance between the piston sidewall and the cylinder wall permits the flexible diaphragm to roll and unroll on the piston sidewall and the cylinder wall during filling and discharging of liquid from the working chamber. There is no positive connection between the diaphragm and the piston. Likewise, the piston rod 26 is not positively connected to the piston 11. Therefore, a positive driving connection for discharging liquid from the working chamber occurs with upward movement of the driving bar which motion is transmitted through the lower connection 15, piston rod 26 and piston 11 to the diaphragm 9. During the fill cycle or downward movement of the driving bar, positive pressure of liquid within the working chamber and/or vacuum on the piston side of the diaphragm are provided to displace the diaphragm and piston downwardly at a rate and to the extent allowed by the movement of the drive bar and intermediate piston rod.

Figure 3:
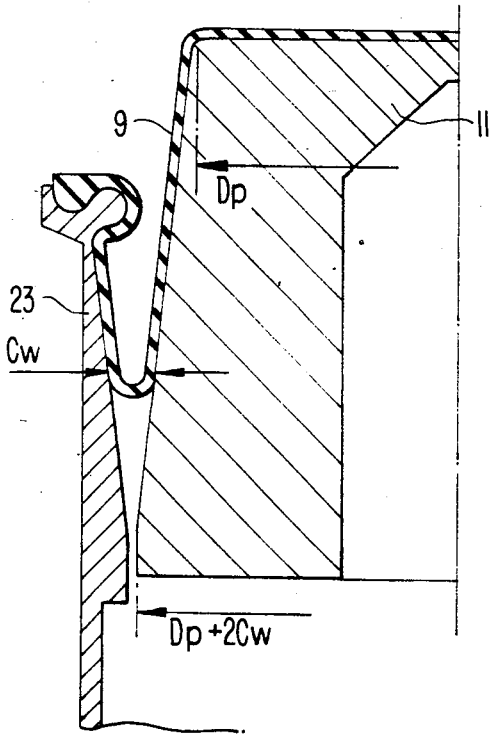
FIG. 3 is a side view in cross-section of a portion of a filling unit of FIG. 2 illustrating opposed surfaces of the cylinder and piston which are tapered.

The spaced, opposed surfaces of the piston sidewall and the cylinder wall between which the diaphragm is rolled and unrolled during filling and discharging are each tapered so that the convolution width of the diaphragm remains essentially constant during the operation of the filling unit. This arrangement is illustrated in FIGS. 2 and 3 wherein it is seen that the spaced, opposed surfaces of the piston sidewall and cylinder wall are tapered a like degree in opposite directions. Referring particularly to FIG. 3, it can be seen that the piston has a diameter Dp at its upper end with the outer surface or sidewall of the piston being tapered outwardly to a diameter Dp $+2C_w$ near the bottom of the piston, $C_w$ being the convolution width of the diaphragm. Although it is known to merely taper a piston to increase the life of a rolling diaphragm carried thereby, applicant has found that by tapering the cylinder as well a like degree but in the opposite direction, the life of the diaphragm is increased considerably further. That is, by tapering the cylinder as well as the piston in the manner described, a constant convolution width $C_w$ is maintained which prevents the diaphragm from wrinkling and being stressed.

During operation of the filling machine, liquid to be dispensed is supplied to each filling unit from a liquid supply 24 where the liquid is under pressure. A valve 25, controlled either manually, by suitable automatic controls or by a check valve, regulates the flow of liquid from the supply 24 to the inlet 12 of each of the filling units. A pinch clamp valve of the type disclosed in U.S. Pat. No. 3,971,494 may be used, for example. Liquid under pressure entering the working chamber 10 through the inlet passage 12 biases the flexible rolling diaphragm 9 and piston 11 downward with the downward movement of the piston being controllably limited by the movement of the common drive bar 6. Discharge of the liquid from the working chamber occurs with the upward movement of the drive bar 6 which is transmitted to the piston and diaphragm by way of a piston rod 26 and lower connection 15. During the discharge stroke, the liquid in the working chamber 10 is forced out of the outlet passage 13 as the valve 25 restricts return movement of the liquid toward the supply 24. The liquid flowing out of the outlet passage 13 is conveyed through a valve 27 controlled either manually, by suitable automatic controls or by a check valve to regulate the flow of liquid from the outlet passage to a container 7 to be filled. The valve 27 may be a nozzle which contains a positive pressure valve such as that disclosed in the commonly owned U.S. patent application Ser. No. 234,407, filed Feb. 13, 1981. Another example of such a discharge nozzle structure is disclosed in U.S. Pat. No. 4,014,472. Alternatively, a pinch clamp valve of the type disclosed in the aforementioned U.S. Pat. No. 3,971,494 may be employed.

Figure 5:
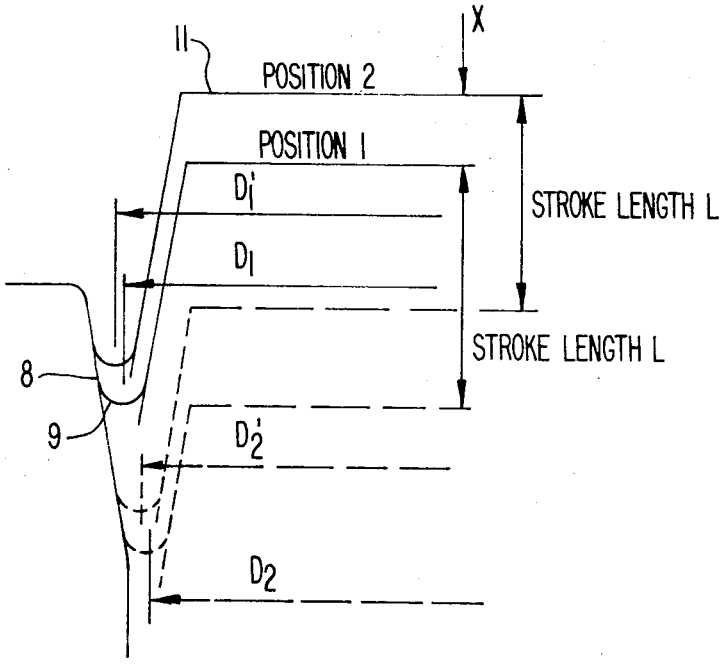
FIG. 5 is a schematic illustration of the cylinder, piston and diaphragm of the filling unit of FIG. 2 showing the piston penetrating to a first position in the cylinder with a given stroke and penetrating to a second position in the cylinder with the same stroke in response to adjustment in the length of the two-part piston rod of the filling unit.

In setting up the filling machine for operation or when it is desired to change the fill volume of liquid dispensed from each filling unit, only one major fill adjustment is required, that of adjusting the micrometer volume control associated with each of the eccentric drive members 16 and 17 connected to the common drive bar 6. This arrangement permits overall adjustment of the discharge stroke of all of the individual filling units 2–5. However, due to the variations from one filling unit or pump to the next mounted on the common drive bar, it is necessary to fine tune each filling unit so that all of the filling units are dispensing the same amount of product. This problem is solved with the diaphragm filling units of the invention by taking advantage of the fact that both the piston sidewall and the spaced, opposed cylinder wall between which the diaphragm is rolled and unrolled during filling and discharging are tapered in opposite directions. That is, the deeper the piston penetrates into the cylinder, the larger is the diameter of the piston and cylinder and the effective diameter of the diaphragm. As the effective diameter of the diaphragm is directly proportionate to the volume dispensed by the filling unit, by adjusting the distance that the piston penetrates into the cylinder, the volume of fill dispensed can be varied. For example, as shown in FIG. 5 of the drawings, with the piston moving through a given stroke length L, the average effective diaphragm diameter $D_A=(D_1+D_2/2)$ where $D_1$ and $D_2$ are the effective diaphragm diameters at each end of the piston stroke L. When the piston penetrates further into the cylinder with the same stroke length L, the average effective diaphragm diameter $D_A'=(D_1'+D_2'/2)$ where $D_1'$ and $D_2'$ are the effective diaphragm diameters at each end of the piston stroke L. The amount of product displaced during a given stroke length L of the piston is defined by $\pi D_A^2/4 \times L$ where $D_A$ is the average effective diaphragm diameter during piston stroke L. Because $D_1'$ is greater than $D_1$ and $D_2'$ is greater than $D_2$, $D_A'$ is greater than $D_A$ and therefore $\pi D_A'^2/4 \times L$ is greater than $\pi D_A^2/4$ L. Thus it is seen that the amount of product displaced is greater although the stroke length L is the same when the piston penetrates further into the cylinder to position 2 rather than position 1.

Figure 4:
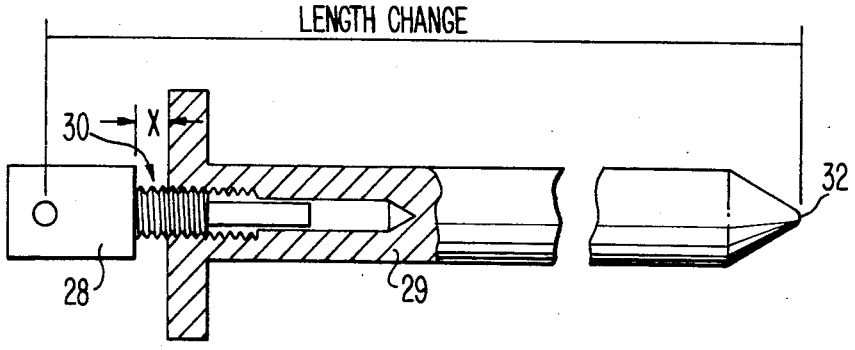
FIG. 4 is a side view, partially in cross-section, of the two-part piston rod of the filling units of FIG. 2.

The step of the method of the invention of changing the distance that the piston penetrates into the cylinder with a given piston stroke length to adjust or fine tune the volume dispensed by each filling unit is accomplished by adjusting the length of the piston rod 26 extending between the piston 11 and the common drive bar 6. This is accomplished by providing the piston rod 26 in a form of a two-part piston rod wherein the parts 28 and 29 are adjustably connected with each other to provide a means for adjusting the length of the piston rod. As shown in FIG. 4, the two-part piston rod 26 includes a first part 28 for connection to the common drive bar 6 and a second part 29 for engaging the piston 11. The first and second parts of the piston rod are adjustably connected in telescoping relation by a threaded connection 30. Thus, the length of the piston rod 26 is adjusted by rotating the second part 29 relative to the first part 28. This can be accomplished while the first part is connected to the common drive bar 6 by way of the lower connection 15 because the second part is free to rotate. A lock nut or set screw may be provided at the threaded connection between parts 28 and 29 to prevent the parts from moving relative to one another after an adjustment has been made in the length of the piston rod.

Because the piston rod 26 extends with play through the bore 31 in the end of the cylinder, during the discharge stroke of the filling unit, the piston 11 may be moved off center in relation to the cylinder 8 causing the diaphragm 9 to rub on itself. By utilizing a rounded or ball tip 32 on the piston rod 26 in cooperation with an adjacent concave opening 33 in the piston 11 as shown in the drawings, the piston can swivel on the ball tip of the piston rod and reduce the possibility or prevent the diaphragm from rubbing on itself.

While I have shown and described only one embodiment in accordance with the invention, it is understood that the same is not limited thereto but is susceptible of numerous changes and modifications as known to those skilled in the art. For example, the filling units of the filling machine may be supported in a horizontal position during operation of the filling unit and during cleaning so that no change in the position is required. The fluid inlet in such a case may be positioned on the top side of the cylinder at the intersection or corner of the sidewall and endwall. The fluid outlet would be located in the endwall on the opposite or lower side of the cylinder so that drainage can occur readily during cleaning. Air trapped in the working chamber escapes through the fluid inlet with this arrangement. A valve such as a pinch clamp valve permits rising air to pass through the valve so that an air bleed provided in the line between the liquid supply and valve in such an arrangement releases the trapped air. Also, while both the cylinder and piston are tapered in opposite directions in the illustrated embodiment, the invention would also have applicability where only one of the piston and cylinder were tapered since the effective diameter of the piston would change with the depth of penetration of piston in such a cylinder although at a slower rate with the same degree of taper. I therefore do not wish to be limited to the details shown and described herein but intend to cover all such changes and modifications as are encompassed by the scope of the appended claims.

I claim:

1. A high-speed filling machine comprising a plurality of individual filling units operated in common from a common drive means, each of said individual filling units including a cylinder, a flexible rolling diaphragm secured within said cylinder to delimit a working chamber in the cylinder on one side of the diaphragm, a single piston arranged with clearance in said cylinder on the other side of said diaphragm for reciprocation in the cylinder, said clearance between the piston and the cylinder permitting said flexible diaphragm to roll and unroll on a sidewall of said piston and a wall of said cylinder during filling and discharging of a fluid from the working chamber of said filling unit, passage means in said cylinder for providing fluid communication with said working chamber, a single piston rod extending between said piston and said common drive means for transmitting a driving force from said common drive means to said piston during a discharge stroke of said filling unit, the sidewall of said piston upon which said diaphragm is rolled and unrolled being tapered outwardly from the end of said piston adjacent said diaphragm to thereby increase the working life of said rolling diaphragm, and means for adjusting a length of said piston rod to change the distance that said piston penetrates into said cylinder with a given piston discharge stroke length whereby the volume dispensed by the individual filling units can be finely adjusted as a result of a change in the average effective diaphragm diameter which occurs with a change of piston penetration in the cylinder in cooperation with the tapered sidewall of said piston.

2. A filling machine according to claim 1, wherein said piston rod includes a piston rod formed of at least two parts which are adjustably connected with each other to provide said means for adjusting the length of said piston rod.

3. A filling machine according to claim 2, wherein a first part of said two part piston rod is connected to said common drive means and an end of a second part of said two part piston rod contacts said piston during said discharge stroke, said first and second parts being adjustably connected with each other.

4. A filling machine according to claim 3, wherein adjacent ends of said first and second parts are adjustably connected in telescoping relation by a threaded connection.

5. A filling machine according to claim 3, wherein said end of said second part of said two part piston rod which contacts said piston during said discharge stroke is rounded so that said piston can swivel about said piston rod to reduce the possibility of the diaphragm rubbing on itself during operation of said filling machine.

6. A filling machine according to claim 1, wherein both the piston sidewall and a spaced, opposed wall of the cylinder upon which said diaphragm is rolled and unrolled during filling and discharging are tapered like degree in opposite directions so that the convolution width of the diaphragm remains essentially constant with reciprocation of the piston in the cylinder during operation of the filling machine thereby increasing the working life of the diaphragm.

7. A filling machine according to claim 1, wherein said common drive means comprises a common drive bar for connection with the piston rods of said plurality of individual filling units, eccentric drive means, and connecting means drivingly connecting said eccentric drive means with said common drive bar to convert the rotary movement of the eccentric drive means into reciprocating movement of the pistons by way of said common drive bar and the piston rods and said connecting means including common volume-adjusting means in said connecting means for adjusting simultaneously the volume of all filling units connected with said common drive bar.

8. A method of finely adjusting the volume dispensed by a filling unit of a high-speed filling machine comprising a plurality of individual filling units driven from a common drive means and wherein each filling unit includes, a cylinder, a flexible rolling diaphragm secured within the cylinder to delimit a working chamber in the cylinder on one side of the diaphragm, a single piston arranged with clearance in the cylinder on the other side of the diaphragm for reciprocation in the cylinder, the clearance between the piston and the cylinder permitting the flexible diaphragm to roll and unroll on a sidewall of the piston and a wall of said cylinder during filling and discharging of a fluid from the working chamber of the filling unit, passage means in the cylinder for providing fluid communication with the working chamber, a single piston rod extending between the piston and the common drive means for transmitting a driving force from the drive means to the piston during a discharge stroke of the filling unit, the sidewall of the piston and the cylinder wall on which the diaphragm is rolled and unrolled being tapered in opposite directions a like degree so that the convolution width of the diaphragm remains essentially constant with reciprocation of the piston in the cylinder during the operation to increase the working life of the diaphragm, comprising the step of changing the distance that the piston penetrates into the cylinder with a given piston discharge stroke length to adjust the volume dispensed by the filling unit as a result of a change in the average effective diaphragm diameter which occurs with a change in piston penetration in the cylinder in cooperation with the tapered sidewall of the piston and tapered cylinder wall.

9. A method according to claim 8, wherein the step of changing the distance that the piston penetrates into the cylinder with a given piston discharge stroke length is effected by adjusting the length of the piston rod extending between the piston and the common drive means.

* * * * *